US009618169B2

(12) United States Patent
Hartman

(10) Patent No.: US 9,618,169 B2
(45) Date of Patent: Apr. 11, 2017

(54) LIGHTING ELEMENT FOR ILLUMINATED HARDSCAPE

(71) Applicant: Michael S. Hartman, Sinking Spring, PA (US)

(72) Inventor: Michael S. Hartman, Sinking Spring, PA (US)

(73) Assignee: HARTMAN DESIGN, INC., Wernersville, PA (US)

( * ) Notice: Subject to any disclaimer, the term of this patent is extended or adjusted under 35 U.S.C. 154(b) by 0 days.

(21) Appl. No.: 14/618,319

(22) Filed: Feb. 10, 2015

(65) Prior Publication Data

US 2015/0300608 A1 Oct. 22, 2015

Related U.S. Application Data

(60) Provisional application No. 61/937,772, filed on Feb. 10, 2014.

(51) Int. Cl.

| | |
|---|---|
| ***F21S 8/00*** | (2006.01) |
| ***F21V 31/04*** | (2006.01) |
| ***F21S 4/20*** | (2016.01) |
| *F21W 131/10* | (2006.01) |
| *F21Y 101/00* | (2016.01) |
| *F21Y 103/10* | (2016.01) |
| *F21Y 115/10* | (2016.01) |

(52) U.S. Cl.

CPC ..... *F21S 8/032* (2013.01); *F21S 4/20* (2016.01); *F21V 31/04* (2013.01); *F21W 2131/10* (2013.01); *F21Y 2101/00* (2013.01); *F21Y 2103/10* (2016.08); *F21Y 2115/10* (2016.08)

(58) Field of Classification Search

CPC . F21V 19/002; F21V 31/04; F21S 8/03; F21S 8/032; F21S 4/20; F21W 2131/10; F21W 2131/103; F21W 2131/109; F21W 2111/02; F21W 2111/023; F21W 2111/027; F21Y 2101/02; F21Y 2103/003

See application file for complete search history.

(56) References Cited

U.S. PATENT DOCUMENTS

| | | | | |
|---|---|---|---|---|
| 4,954,931 | A * | 9/1990 | Hassler, Jr. | F21V 7/00 362/255 |
| 5,390,090 | A * | 2/1995 | Nau | F21S 8/022 362/145 |
| 5,678,920 | A | 10/1997 | Kerr | |
| 5,927,845 | A * | 7/1999 | Gustafson | B64F 1/002 362/152 |
| 5,951,144 | A | 9/1999 | Gavigan | |
| 6,027,280 | A | 2/2000 | Conners | |
| 6,065,853 | A | 5/2000 | Crevier | |
| 6,082,886 | A | 7/2000 | Stanford | |
| 6,116,751 | A * | 9/2000 | Remp | E01C 17/00 362/153 |

(Continued)

*Primary Examiner* — Bao Q Truong
(74) *Attorney, Agent, or Firm* — Fox Rothschild LLP

(57) ABSTRACT

A lighting element for an illuminated hardscape. The lighting element includes a body structure defining a dispersion surface. A light fixture is positioned within the body structure and is configured to provide a light which is dispersed through the body structure to the dispersion surface. The body structure is formed from a clear or translucent material. An illuminated hardscaping is also provided.

26 Claims, 6 Drawing Sheets

(56) References Cited

U.S. PATENT DOCUMENTS

| | | | | |
|---|---|---|---|---|
| 6,676,284 | B1 * | 1/2004 | Wynne Willson | F21S 8/032 362/231 |
| 6,776,504 | B2 * | 8/2004 | Sloan | F21S 8/032 362/147 |
| 6,860,624 | B2 | 3/2005 | Hille et al. | |
| 7,070,294 | B2 | 7/2006 | Patti | |
| 7,213,941 | B2 * | 5/2007 | Sloan | F21V 21/005 362/20 |
| 7,556,394 | B2 | 7/2009 | Patti | |
| 7,699,489 | B2 | 4/2010 | Hagen | |
| 8,079,744 | B2 | 12/2011 | Tsao et al. | |
| 8,092,053 | B1 | 1/2012 | Kopp | |
| 8,118,456 | B2 | 2/2012 | Reed et al. | |
| 8,313,208 | B2 | 11/2012 | Tyson et al. | |
| 9,169,607 | B2 | 10/2015 | Schweizer et al. | |

* cited by examiner

FIG. 9
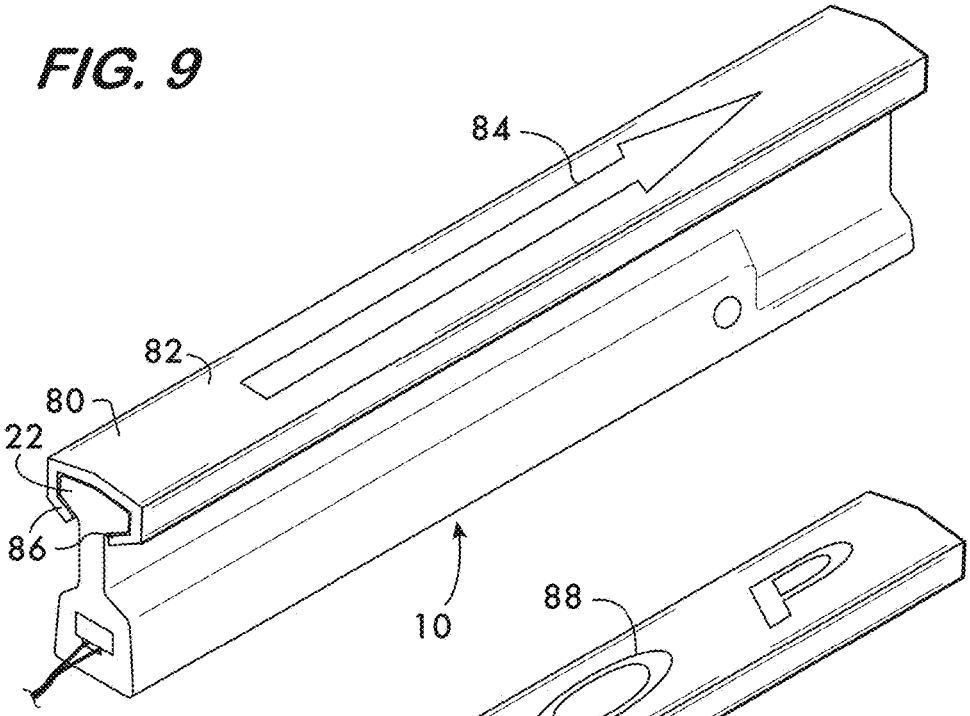
FIG. 10
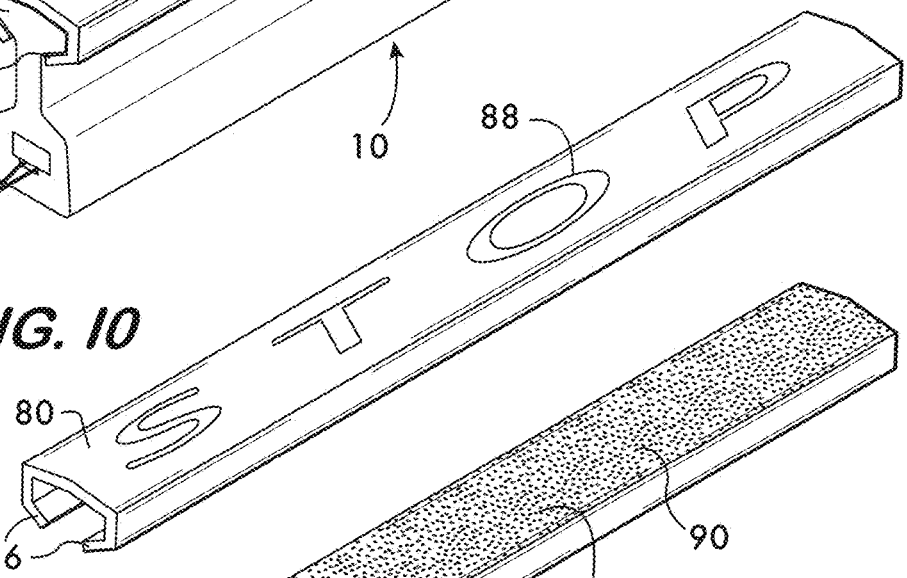
FIG. 11

LIGHTING ELEMENT FOR ILLUMINATED HARDSCAPE

CROSS REFERENCE TO RELATED APPLICATIONS

This application is a non-provisional application of U.S. Provisional Application No. 61/937,772 filed Feb. 10, 2014, the disclosure of which is hereby incorporated herein by reference in its entirety.

FIELD OF THE INVENTION

Broadly, the present invention relates the ground lighting. More particularly, the present invention relates to lighting elements for illuminating and or providing markers within hardscape structures such as patios, driveways, roadbeds and walkways.

BACKGROUND OF THE INVENTION

Masonry and other hard structures used as a part of a landscape design are known as the "hardscape". The hardscape incorporates structures such as pathways, sidewalks, steps, driveways, retaining walls and the like into an aesthetic installation generally, although not exclusively, in an outdoor setting which combines plant, masonry, and lighting elements to enhance the visual environment of a residence, commercial facility or school campus to cite but a few examples.

The hardscape may be formed, inter alia, of concrete, natural stone, bricks or blocks manufactured from concrete or other hard materials which are available in various colors, shapes and textures that simulate natural or quarried stone. Such products, for example, those provided by companies such as EP Henry of Woodbury, N.J., constitute structural systems which allow for the construction of structures such as patios, driveways, roadbeds and walkways using discrete masonry elements that may be positioned adjacent one another to form a surface without the use of mortar. The structure is, nevertheless, a substantially permanent structure due to the weight, regular shape, friction and quasi-interlocking nature of the discrete elements.

As lighting is often an important component of the landscape design, it is desirable to incorporate lighting elements, such as lamps or markers, into the design. Present practice features stand-alone lamps that mount adjacent to the hardscaping and which may also require an electrical box adjacent the hardscaping, often requiring significant modification of one or more of the discrete elements around the lamp. It would be advantageous to provide lamps that form an integral part of the hardscape and which require minimum modification of the hardscaping.

SUMMARY OF THE INVENTION

Broadly, the present invention provides a lighting element for an illuminated hardscape. The lighting element includes a body structure defining a dispersion surface from which the light is dispersed to the environment outside the lighting element and which comprises a material through which light can pass, such as a clear or translucent material. A light fixture is positioned within the body and is configured to provide the light which passes through the material of the body to the dispersion surface.

Another embodiment of the invention is directed to a hardscape structure that incorporates the lighting element between elements of the horizontal hardscape structure. In one form, the body structure of the lighting element has a configuration which facilitates positioning of hardscape filling material thereabout and between adjacent hardscape elements. For example, the lighting element body structure can have an I-beam like cross-section. A method of illuminating a hardscape is also provided.

In another embodiment of the invention, a cover can be provided for the dispersion surface of the light element. The cover can be used to change the color of the light emitted from the lighting element, add indicia or symbols which can be lit up, and even change the texture of the dispersion surface.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings:

FIG. 9 is a perspective view of another embodiment of the invention which shows an exemplary cover for the lighting element shown in FIG. 1;

FIG. 10 is a perspective view of second exemplary cover for the lighting element shown in FIG. 1; and FIG. 11 is a perspective view of a third exemplary cover for the lighting element shown in FIG. 1.

DETAILED DESCRIPTION OF THE INVENTION

Figure 1:
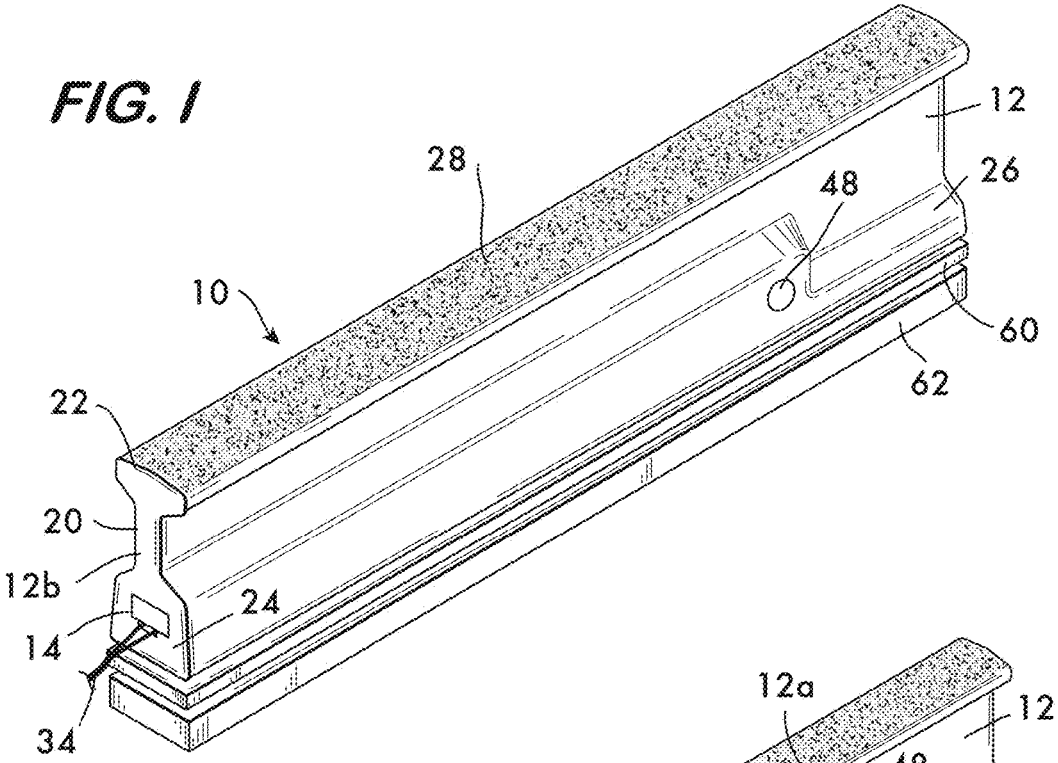
FIG. 1 is a perspective view of a lighting element according to an exemplary embodiment of the invention.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Referring to FIGS. 1-7, a lighting element 10 in accordance with the invention will be described. The lighting element 10 generally includes a body structure 12 with at least one light fixture 16 positioned or embedded within the body 12. In a preferred embodiment, an internal channel 14 is provided within the body 12 in which the light fixture 16 is positioned. A plug 18 is configured to seal closed the channel 14 with the lighting fixture 16 within. The body structure 12 includes a material, such as a clear or translucent material, through which the light can pass from the light fixture 14 to the surface of the light element 10 for dispersion of the light into the environment as desired. The body 12 is preferably formed as a unitary integral unit molded from a translucent polycarbonate with a UV inhibitor, or any other material suitable for the outdoor environment. Further details of the illustrated embodiment are now provided.

If the lighting element 10 is intended to throw light, the body structure 12 may be made out of a clear material such as a clear polycarbonate material. In the preferred embodiment, it is desirable to provide a glowing lighting element 10 that can be used as a marker or delineator. To this end, it is believed that a clear, completely translucent material would throw light rather than disperse light. To help disperse the light, if desired to make the product more of a lit marker or delineator, a pigment may be mixed with the material. For the pigmented version, it has been found that a material made up of approximately 98% clear polycarbonate and 2% white polycarbonate mixed thoroughly prior to the molding provided the preferred amount of light dispersion or glow. The invention is not limited to the given ratio, and other ratios may be utilized to provide a desired lighting effect. Further, while a white pigment is preferred, other colors may be used such that light of any desired color may be dispersed.

Figure 4:
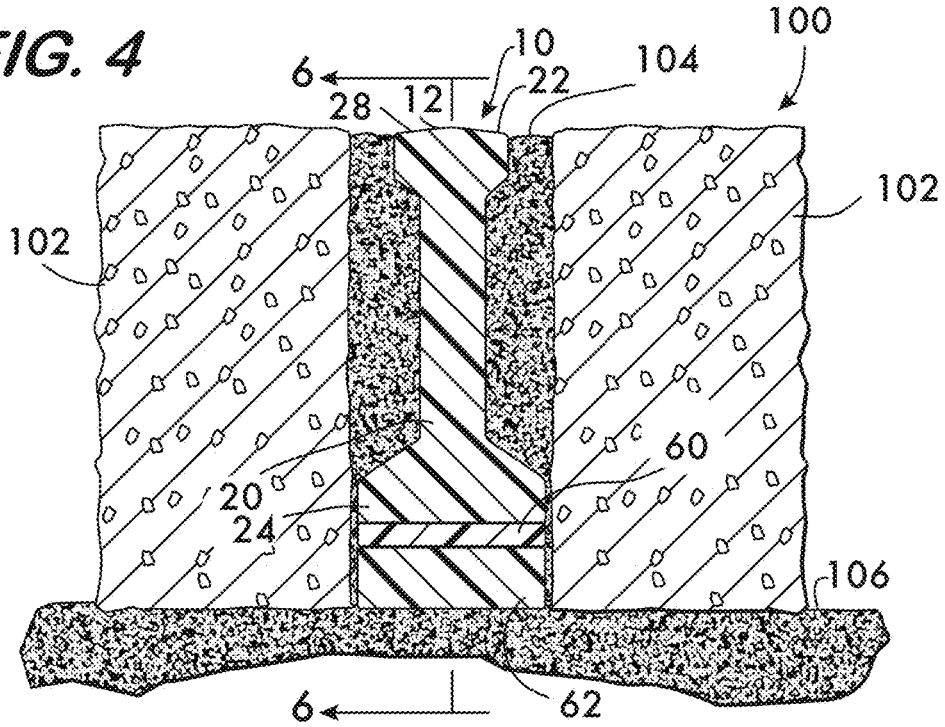
FIG. 4 is a cross-sectional view along the line 4-4 in FIG. 3.
Figure 5:
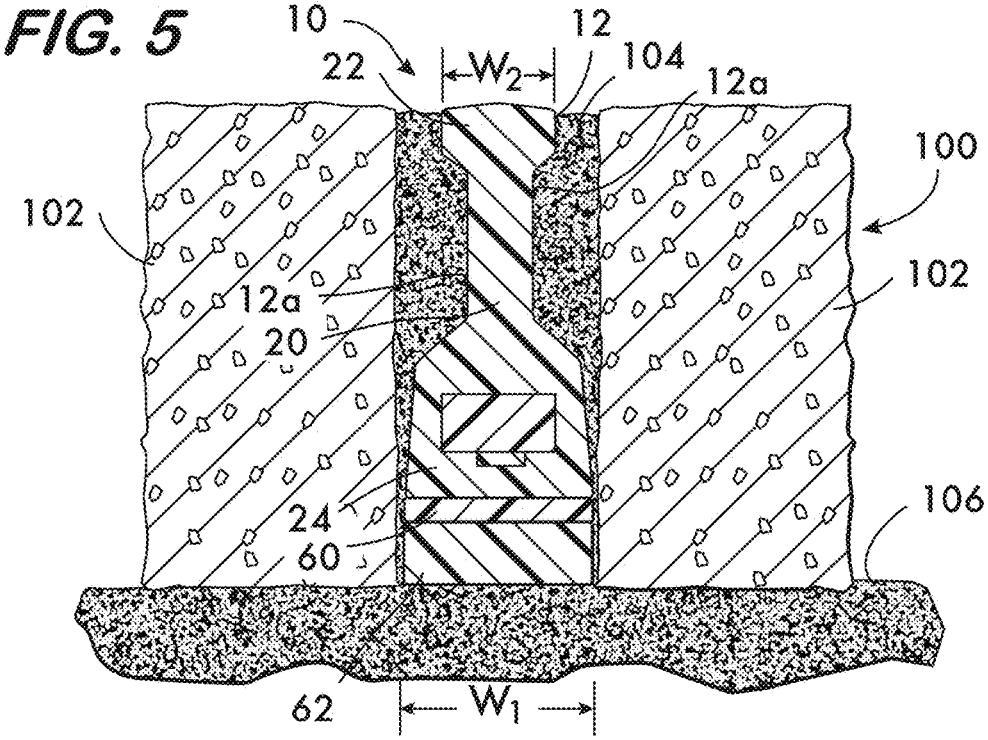
FIG. 5 is a cross-sectional view along the line 5-5 in FIG. 3.

The body structure 12 is shaped preferably to cooperate with the hardscaping and be held in place thereby. For example, a body 12 with changes in width along the sides 12*a* of the body 12 will cooperate with sand and other fill materials to hold the light element 10 in place with the hardscape blocks 102 as further described below. Such changes in width can include indentations and structures that extend from the sides of the body into the fill material, or other types of changes in the cross sectional width of the body 12 along the sides 12*a* which can cooperate with the fill material to help hold the light element 10 in place. In the illustrated embodiment, such changes in width are provided by the longitudinally extending light element body 12 having an I-beam or rail like cross-section with a center section 20 extending between a wider top flange section 22 and a wider bottom flange section 24. As illustrated in FIGS. 4 and 5, in this embodiment, the bottom section 24 has a width W1 that is larger than the width W2 of the top section 22, with the width of the center web like section 20 being thinner than both W1 and W2. With this configuration, the bottom flange like section 24 defines the spacing between adjacent hardscape blocks 102 of hardscape 100, and space is provided around the center section 20 and the top section 22 to receive a known filling material 104 such as concrete, mortar, sand, or polymeric sand. Sand and polymeric sand, unlike concrete and mortar, provide for easier removal of the lighting element 10 if necessary. Polymeric sand has an adhesive like quality to help hold the light element 10 in place. As such, the shape of the body structure 12 can cooperate with its surroundings which helps hold it in place.

Figure 2:
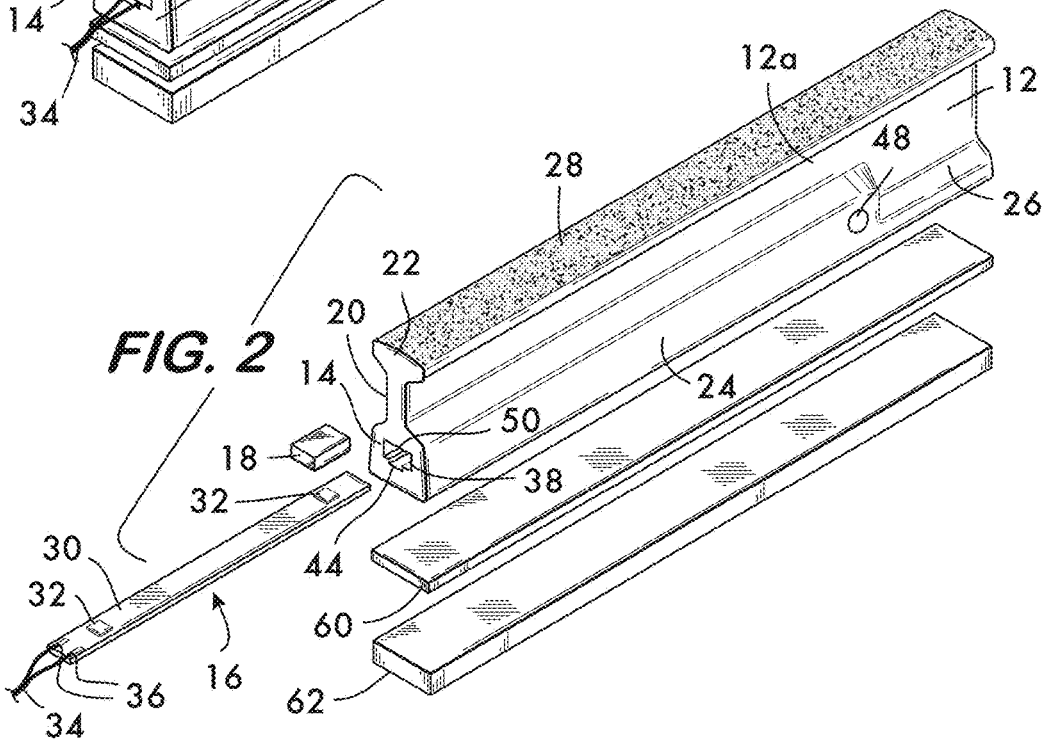
FIG. 2 is an exploded perspective view of the lighting element shown in FIG. 1.

Referring to FIGS. 1, 2 and 4, it is seen that the bottom flanged section 24 may have a notched area 26 with a width equal to that of the central section 20. The notched area 26 is provided in the area beyond the internal channel 14 and thereby reduces material necessary for manufacture of the body structure 12 and also makes it easier to cut off a portion of the body structure 12 to modify the length thereof if necessary. While an I-beam or rail like cross-section is described and illustrated, the body 12 is not limited to such a configuration and may have other configurations, for example, rectangular, curved, circular, trapezoidal, inverted T-shape or the like. Moreover, other configurations having a thinner center section between wider top and bottom sections to help hold the body in place by use of filler material 104 may be used. In the illustrated embodiment, the body extends longitudinally with the I-Beam or rail like cross section, the length of which is chosen to work with the hardscaping blocks 102; here the length being substantially the same length as the adjacent blocks 102.

The top flange section 22 of the illustrated body structure 12 has a dispersion surface 28 which disperses light coming from the light fixture 16. The dispersion surface 28 is preferably a convex surface, slightly convex as shown, with the curvature aiding in light distribution as well as naturally shedding dirt and water to maintain a clean light emitting surface. Other configurations may be used. The dispersion surface 28 may be formed preferably as a roughened surface such that the texture and appearance are similar to that of the hardscape blocks 102. The height from the bottom of the bottom section 24 to the dispersion surface 28 is preferably approximately equal to the height of the hardscape blocks 102. The lighting element 10 is preferably positioned relative to the hardscape blocks 102 such that the dispersion surface 28 is substantially even with the top surface of the hardscape blocks 102.

As illustrated in FIGS. 1, 4 and 5, optional shims 60, 62 may be provided to increase the height of the lighting element 10. For example, the lighting element 10 may be provided with at least two shims 60, 62 with different heights such that a multitude of heights may be achieved. In the exemplary embodiment, the body structure 12 has a height of 2 inches while the first shim 60 has a height of one-eighth of an inch and the second shim 62 has a height of one-quarter of an inch. With such a kit, heights of 2 inches, 2.125 inches, 2.25 inches and 2.375 inches may be achieved by use of one or both shims. Alternatively, additional or less base material 106 or fill material 104 may be positioned beneath the bottom section 24 to adjust the height. The illustrated shims 60, 62 have a solid, rectangular configuration with a width and length equal to the width and length of the bottom flange section 24 (e.g., 8 inch length and ¾ inch width), however, other configurations may be utilized. The shims 60, 62 may have through holes or indentations which save material during manufacture, and also assist in locking in the position of the shims 60, 62 by receiving there within base or fill material.

Referring to FIGS. 2 and 5-8, the lighting fixture 16 is positioned within the internal channel 14 to provide the light which is dispersed through the body structure 12. The lighting fixture 16 includes a circuit board 30 having a light source 32 mounted thereon, as well as other electrical components for the light circuit as known. In a preferred embodiment, the light source 32 is formed of one or more LEDs, here two square arrays of LEDs having parallel circuitry. Exemplary LEDs may use 0.5 watts each and thus heat is not much of a problem. Nevertheless, the circuit board 30 may be manufactured from or include a metal or the like which acts as a heat sink, for example, aluminum or nickel plated copper. The LEDs in the preferred embodiments put out a white or a warm white light, with white being a brighter white while warm white being a yellow or white such as with incandescent light bulbs. Electrical wiring 34 is soldered to leads 36 on the circuit board 30 for power. The lighting fixture 16 is preferably powered by low voltage, preferably within the range of 12 to 24 volts either AC or DC, and thus may require a transformer at the power source.

The internal channel 14 extends into the bottom flange section 24 a distance preferably greater than 50% the length of the body section, but less than 100% of the total length. More preferably, the internal channel 14 extends approximately 75% of the length of the body 12 beginning at the channel opening 38 and terminating at a channel closed end 40. It is apparent that the bottom section 24 has a height sufficient to include the internal channel 14 within. With such a configuration, with the lighting fixture 16 positioned within the channel 14, the light source 30 is preferably centered lengthwise along the body structure 12 to provide a uniform lighting effect at the dispersion surface 28. Where multiple LEDs or other light sources are used, they are preferably separated from one another and positioned within the body 12 to provide a uniform or otherwise desired lighting effect.

During assembly, after the light fixture 16 is placed into the channel 14, the channel 14 is filled preferably with a clear or translucent potting material 42, such as a two part silicone or epoxy potting material, that preferably remains soft or gel like. The potting material 42 seals and protects the electrical components from the environment and fixes the light fixture 16 in place within. The plug 18 is configured to close and seal the open end 18 of the channel 14. As illustrated in FIG. 5, the plug 18 has a cross-section which complements the configuration of the channel 14 such that when positioned therein, the plug 18 seals the channel 14. The plug 18 is preferably manufactured from the same material as the body structure 12, and is fixedly sealed adhesively to the body via the potting material 42.

Figure 6:
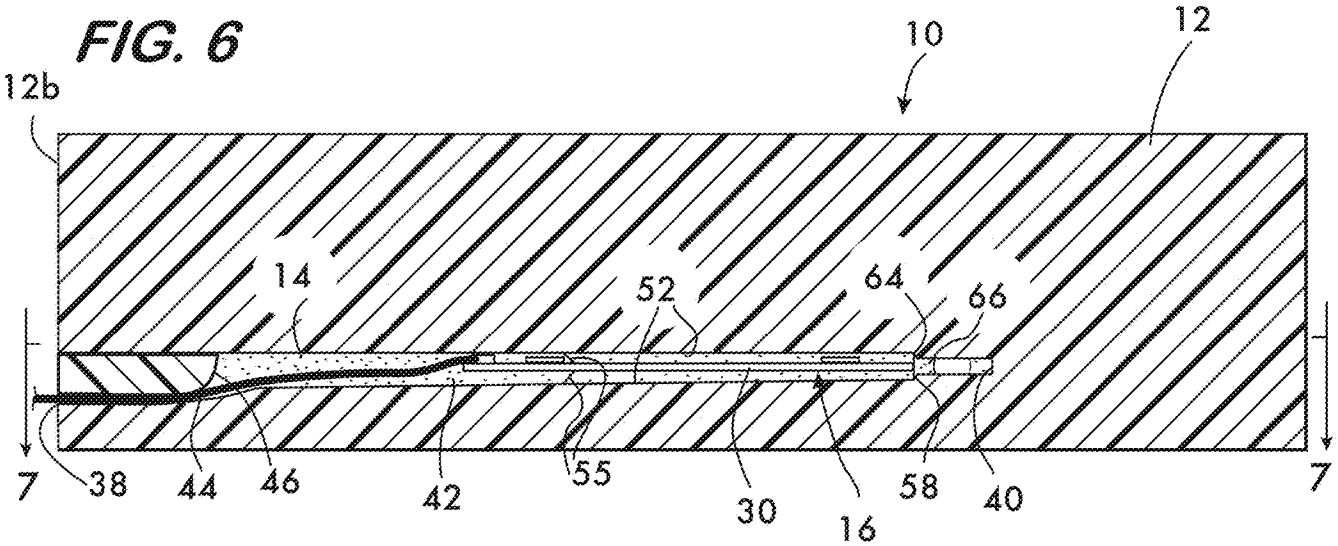
FIG. 6 is a cross-sectional view along the line 6-6 in FIG. 4.

To facilitate passage of the lighting fixture wire 34 into the channel 14, a tapered relief channel 44 is formed along the lower section of the open end 38 of the internal channel 14. As illustrated in FIGS. 5 and 6, the relief channel 44 has a height approximately equal to height of the wiring 34 and extends a distance slightly greater than the length of the plug 18 such that the wire 34 can pass freely into the channel 14 without being crimped or cut by the plug 18. Such a configuration provides a strain relief for the lighting fixture 16 in the event the wire 34 is inadvertently pulled. As illustrated in FIG. 6, the plug 18 may have a rounded front end 46 which acts to guide the wire 34 into the relief channel 44 as the plug 18 is positioned into the open end 38 without cutting into the wire. The potting material 42 seals the wire 34 in the relief channel 44.

Figure 7:
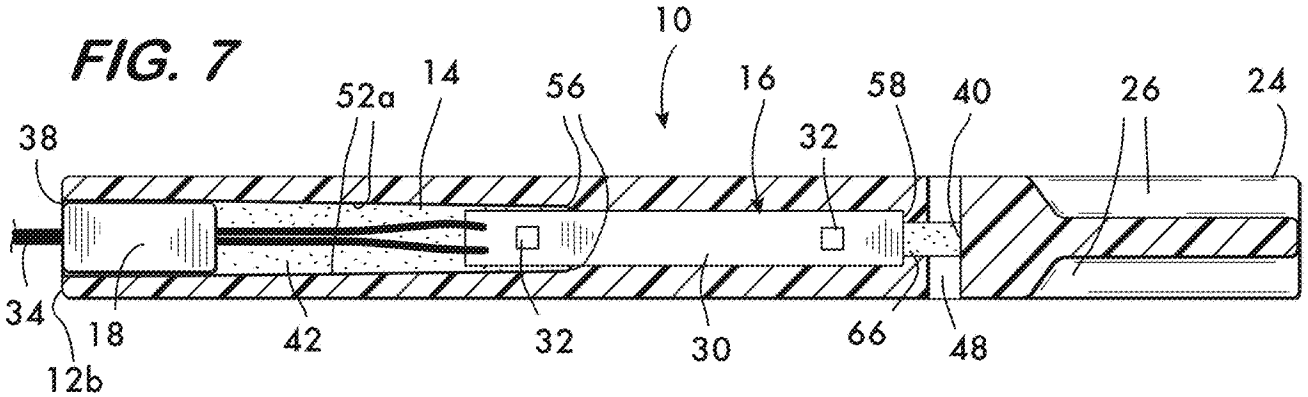
FIG. 7 is a cross-sectional view along the line 7-7 in FIG. 6.

In a preferred method of manufacture, the body structure 12 is molded as a unitary integral member with the internal channel 14 and relief channel 44 formed therein. In this regard, one or more removable cores on molding tool inserts (not shown) defining the configuration of the channels 14 and 44 are positioned within the mold and the body structure 12 is then molded about the cores. The channel 14 may taper outwardly from the closed end 40 to the open end 38 to facilitate removal of the molding cores. Additionally, if any supports are utilized to support the cores during the molding process, they may leave holes in the body structure 12, however, such holes may be plugged with corresponding plug members 48 as illustrated in FIGS. 1 and 7. The plug members 48 are preferably formed of the same material as the body 12, and placed within the openings while still soft from the forming process.

Figure 8:
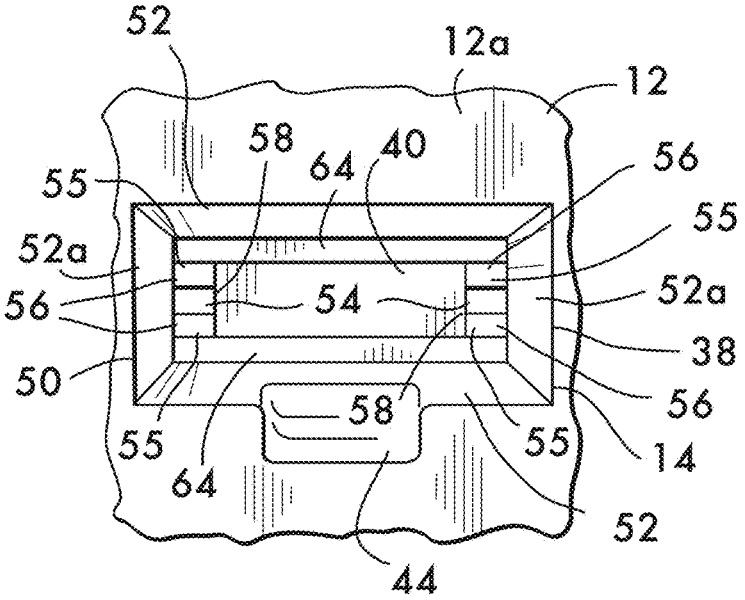
FIG. 8 is a sectional view of the internal channel of the lighting element looking from the open end of the channel into the channel, with the light fixture and electrical cord removed from the channel.

In the illustrated embodiment, the internal channel 14 is configured to position the light fixture 16 in a preferred centered position longitudinally parallel with the top and bottom sections 22, 24, and in a flat orientation, which position is fixed in place by the potting material 42. This preferred configuration is now described in more detail As best seen if FIGS. 2, 6, 7 and 8, the channel 14 begins at the opening 38 on the side end 12*b* of the body 12, and extends longitudinally through the bottom rail section 24 of the body 12 to the channel closed end 40. With further reference to FIG. 8 the channel opening 38 is defined by the edge 50 of the opening 38, and includes the open end of the wire relief channel 44. As noted above, the channel 14 may taper to a smaller cross section moving from the opening 38 to the closed end 40 to allow removal of a core or tool used to form the channel 14 during the molding process. The tapered channel walls, top and bottom walls 52, and opposing side walls 52*a*, are identified in the Figures (see, e.g., FIGS. 6, 7 and 8). Moving from the left end of the opening 38 to the right in FIGS. 6 and 7, it is seen that the lighting fixture 16, i.e., the circuit board 30 thereof, fits within slots 54 formed on opposing sides of the channel walls 52*a*. The slots 54 are formed during the molding process by upper and lower slot shoulders 56 extending from the side walls 52*a*, leaving the open slot area 54 into which the circuit board 30 can slide. The slots have a front end face 55 preferably tapered to guide the light fixture 16 into the slot 54 as it is pushed toward the right in FIGS. 6 and 7. The slots 54 end at the slot back end 58 against which the light fixture 16 abuts to fix the centered position within the body 12. At the end of the slots 54 (moving to the right in FIGS. 6 and 7), upper and lower shoulders 64 further minimize the height of the channel 14 and form back channel section 66. The closed end 40 of the channel 14 is shown in FIG. 8.

Other configuration for the channel 14 may be used to position and orient the light fixture 16 within. For example, making the height of the channel 14 substantially smaller than the width of the light fixture 14 would prevent the fixture 14 from becoming angled within.

Figure 3:
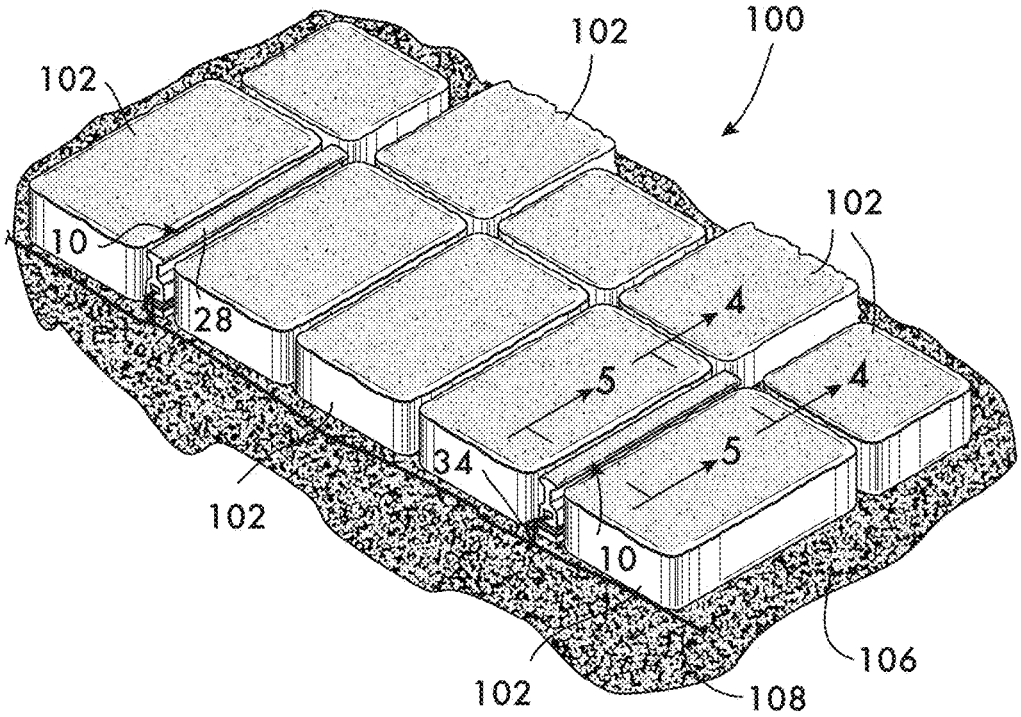
FIG. 3 is a detailed perspective view of a portion of a hardscape structure including lighting elements according to the invention.

Having described a lighting element 10 in accordance with an exemplary embodiment of the invention, an illustrative illuminated hardscape 100 incorporating the lighting elements 10 will be described with respect to FIGS. 3-5. The illuminated hardscape 100, in this example, may be the aforementioned patio, driveway, roadbed or walkway. As illustrated, the hardscape 100 includes a plurality of blocks 102 positioned in a desired pattern. The blocks 102 may all be of the same size and shape or may have differing sizes or shapes. The blocks 102 are supported preferably on a bed of base material 106, as known in the art, such as a prepared stone or sand.

A plurality of lighting elements 10 are integrally mounted within the hardscape 100 by positioning the body structure 12, and if desired the shims 60, 62, between adjacent blocks 102. In the illustrated embodiment, the blocks 102 adjacent the lighting element 10 abut or are next to the bottom section 24 of the lighting element 10 so that the width W1 of the bottom section 24 sets the width between the blocks adjacent the lighting element 10. When used with blocks 102, preferably, the lighting element 10 should be substantially the same length as the length of the side of the block 102 adjacent to the light element 10. The wiring 34 extends from each lighting element 10 and is connected to a main wiring 108 which in turn is connected to a power source (not shown). The wiring 34 and 108 preferably runs beneath or between the hardscaping elements or in the ground adjacent the hardscaping to the power source as shown and as known in the art to remain out of sight and protected from the environment. Once the blocks 102 and lighting elements 10 are positioned, fill material 104 is positioned between adjacent blocks 102 and also between the lighting elements 10 and the blocks 102 adjacent thereto. A shaker or the like may be utilized to assist in placing the filling material as is known in the art. As explained above, the fill material 104 fills around the body structure 12 and secures the lighting element 10 within the hardscape 100. No special tools are required, and the components of the lamp are readily accessible for repair or replacement, providing significant ease of maintenance. Once fully installed and the wiring 34 is connected to a suitable power source, preferably with a power switch that may or may not be controlled by a timer, the power can be turned on to illuminate the lighting element 10 and create the desired lighting effect to the hardscape.

Although lighting elements are shown oriented horizontally in the hardscape 100, it is understood that a vertical orientation is also feasible by positioning the lighting elements 10 within the vertical seam between two adjacent blocks in a wall structure or the like. As illustrated, the top of the light element 10, here the dispersion surface 28, is approximately aligned with or slightly above the top surface of the hardscape blocks 102 to provide a minimum light element profile while providing the desired lighting effect. In one preferred configuration for use with blocks 102 having approximately an 8 inch length, the light element 10 can be dimensioned approximately as follows: length—8 inches, width W1 of bottom section—¾ inch, width W2 of top section—½ inch, width of central section—¼ inch. Other preferred configurations for a longitudinally extending light element 10 similar to that shown in FIG. 1 include the following range of dimensions: longitudinal lengths from about 4 inches to about 12 inches; heights from about 1 inches to about 3 inches; top dispersion surface widths W2 of about ¼ inch to about 1 inch; and bottom section widths W1 of about ½ inch to about 1½ inches. In other configurations, the lighting element 10 can take on other shapes and sizes such as square, circular, etc., and incorporate different color lights. Furthermore, additional lighting fixtures 16 can be provided in one or more internal channels 14.

A key benefit of the invention is that regardless of the shape or configuration, the lighting element 10 can be made as a unitary block having the desired shape and size, and of material suitable for the outdoor environment and which can transmit light from the light fixture within to at least one surface of the device for providing the desired lighting effect. Moreover, positioning the lighting fixture 16 within an internal channel 14, sealed within the body 12 from the environment outside, allows the light fixture and its electronic components to be completely protected from the environment while the light created thereby is readily transmitted through the material to the desired outer surface for the desired lighting effect.

Another embodiment of the present invention is now described with reference to FIGS. 9, 10 and 11. As will be further described below, a cover 80 can be attached to the dispersion surface 28 of the light element 10 to add different colors, designs, words, symbols, textures, etc.

With initial reference to FIG. 9, a light element 10 similar to that described above with reference to FIG. 1 is shown. Here, a cover 80 placed over the top section 22 is illustrated. The cover 80 has a cover top 82 and is attached to the top of the top flange section 22. This cover 80 does not allow the light to pass except through the area formed as an arrow 84 as shown. In this way the light effect will be to show an arrow pointing in the desired direction. The cover 80 can be made of any suitable material, such as polycarbonate, and can be colored to prevent light from passing through except in the arrow area, or the arrow area 84 can be formed as a cutout from the cover 80 allowing the light from the dispersion surface underneath to pass through. It is appreciated that the entire cover 80 can be configured to pass light, or just a desired portion of the cover. Moreover, the desired portion to pass light can include a material that passes light, such as a clear or translucent material, or be formed as a cut out in the cover 80.

Any suitable means to attach the cover 80 to the upper section 22 of the light element 10 can be used. This includes mechanical means, adhesives, etc. One preferred means as illustrated is to shape the cover to cooperate with the section of the light element 10 to which it will attach, such as a dove-tail type arrangement. For example, here the cover 80 has arms 86 extending downward from the cover top section 82 and which arms are configured to compliment and wrap around the upper flange section 22, allowing the cover to slide onto the light element 10 prior to installation with the hardscaping 100. The dimensions of the cover can be made so that the cover 80 friction fits over the top section 22, thereby securely affixing the cover to the light element 10. It is appreciated that the light element may need to be positioned a little lower in the ground to compensate for the thickness of the cover 80. Another possible attachment means is to configure the cover 80 to snap onto the light element 10.

The cover 80 can be configured to provide the desired lighting effect. In FIG. 9 an arrow 84 is shown as discussed above. It can be made of a material allowing light to pass while the remainder of the cover 80 is made of a material that does not pass light, or the arrow can be formed as a cut out. In FIG. 10 an example of a cover 80 with indicia 88, e.g., letters to form the word "STOP", is shown. Again, the letters can be made of a translucent material of the desired color, while the remainder of the cover is made of a non-translucent material or of a material of a color different than the letters. Alternatively, the letters can be formed as cutouts in the cover top 82. As another feature, different colors and textures can be provided on the cover top 82 to provide different lighting effects as illustrated in FIG. 11. Roughened, smooth, dimpled, or any type of texture 90 can be formed into the cover top 82 to provide the desired lighting effect, here preferably using a translucent cover. Likewise, the cover 80 can be used to alter the color or provide color effects to the lighting element 10.

Light elements 10 according to the invention provide a simple and elegant illumination for hardscape design that is easy to install and maintain. Such light elements are readily removable and repositionable and facilitate repair or reconfiguration of the hardscape as required. They may be used with any form of hardscape, for example, concrete products such as blocks or bricks, natural stone, mortared or stacked structures, and poured concrete structures to cite but a few exemplary applications.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A lighting element for an illuminated hardscape, the lighting element comprising:

a body structure defining a top dispersion surface and an internal channel formed in the body structure below the top dispersion surface, the body structure being formed from a material through which light can pass, said body structure comprising:

a center section, a top section which includes said top dispersion surface, wherein said top section has a width that is greater than a width of said center section, and a bottom section having a width that is greater than the width of said top section; and a light fixture positioned within the channel and configured to provide a light which passes through the body structure to the dispersion surface.

2. The lighting element of claim 1 wherein said material from which the body structure is formed is a translucent material.

3. The lighting element of claim 1 wherein said light fixture comprises at least one LED electrically connected to a circuit board.

4. The lighting element of claim 3 wherein said LED comprises at least two LEDs spaced from one another.

5. The lighting element of claim 1 wherein said channel comprises side walls, and wherein said side walls include a slot in which said light fixture is fixed within said channel.

6. The lighting element of claim 5 wherein said slot comprises two slots, one formed on each of said channel side walls.

7. The lighting element of claim 1 wherein said body is formed as a unitary member of a material through which light can pass.

8. The lighting element of claim 1 further comprising a cover attachable to said dispersion surface, at least a section of said cover comprising a material through which light can pass.

9. The lighting element of claim 8 wherein said cover has arms shaped to compliment and slidingly attach to said dispersion surface.

10. The lighting element of claim 1 further comprising at least one shim positionable underneath said lighting element.

11. The lighting element of claim 1 wherein said body structure extends longitudinally a length in the range of about four to twelve inches and a height in the range of about one to three inches, and said dispersion surface has a width in the range of about one-half to one inch.

12. An illuminated hardscape, comprising:

a plurality of discrete hardscape elements adjacent to one another; and a lighting element positioned between two of said hardscape elements, said lighting element comprising:

a body structure defining a top dispersion surface, said body structure including a material through which light can pass to said dispersion surface, said body structure comprising:

a center section, a top section which includes said top dispersion surface, wherein said top section has a width that is greater than a width of said center section, and a bottom section having a width that is greater than the width of said top section, a light fixture positioned within said body structure and configured to provide a light which passes through the body structure through the light passing material to the top dispersion surface.

13. An illuminated hardscape in accordance with claim 12 wherein said body structure includes a channel formed within said body structure, said light fixture being positioned within said channel.

14. An illuminated hardscape in accordance with claim 13 further comprising a filler material between said discrete hardscape elements and said lighting element.

15. An illuminated hardscape in accordance with claim 13 wherein said lighting element has a length substantially the same as a length of a said discrete hardscape element positioned adjacent to said lighting element.

16. An illuminated hardscape in accordance with claim 13 wherein said lighting element is positioned at a substantially same elevation as a discrete hardscape element adjacent to said lighting element.

17. An illuminated hardscape in accordance with claim 15 wherein said lighting element extends longitudinally, has a length that is at least about 6 inches, and has a dispersion surface width no greater than about 1 inch.

18. An illuminated hardscape in accordance with claim 14 wherein said lighting element has a side that includes at least one indentation which cooperates with said filling material to affix said lighting element between said discrete hardscape elements.

19. An illuminated hardscape in accordance with claim 18 wherein said indentation comprises a central section of said lighting element between upper section and lower sections of said lighting element, said central section having a width that is less than the widths of said upper and lower sections.

20. A lighting element for an illuminated hardscape, the lighting element comprising:

a body structure defining a top dispersion surface, said body structure including a material through which light can pass to said dispersion surface, said body structure comprising:

a center section, a top section which includes said top dispersion surface, wherein said top section has a width that is greater than a width of said center section, and a bottom section having a width that is greater than the width of said top section;

a light fixture positioned within said body structure and configured to provide a light which passes through the body structure through the light passing material to the dispersion surface.

21. A lighting element in accordance with claim 20 wherein said body structure includes a channel formed within said body structure, said light fixture being positioned within said channel.

22. A lighting element in accordance with any one of claim 20 wherein said body structure extends longitudinally a length in the range of about four to twelve inches and a height in the range of about one to three inches, and said dispersion surface has a width in the range of about one-half to one inch.

23. A method of illuminating a hardscape, comprising:

positioning a plurality of discrete hardscape elements adjacent one another over the ground;

providing a lighting element as set forth in claim 20, said lighting element being positioned between two of said elements;

connecting a wire from the lighting element to a power source; and turning on said power source to illuminate said lighting element.

24. An illuminated hardscape, comprising:

a plurality of discrete hardscape elements adjacent to one another;

a lighting element positioned between two of said hardscape elements, said lighting element comprising:

a body structure defining a top dispersion surface, said body structure including a material through which light can pass to said dispersion surface, said body structure including a channel formed within said body structure, a light fixture positioned within said channel and configured to provide a light which passes through the body structure through the light passing material to the top dispersion surface; and a filler material between the discrete hardscape elements and the lighting element.

25. An illuminated hardscape in accordance with claim 24 wherein said lighting element has a side that includes at least one indentation which cooperates with said filling material to affix said lighting element between said discrete hardscape elements.

26. An illuminated hardscape in accordance with claim 24 wherein said indentation comprises a central section of said lighting element between upper section and lower sections of said lighting element, said central section having a width that is less than the widths of said upper and lower sections.

* * * * *